US010137686B2

(12) United States Patent
Kusunoki et al.

(10) Patent No.: US 10,137,686 B2
(45) Date of Patent: Nov. 27, 2018

(54) INK JET HEAD AND INK JET APPARATUS HAVING THE SAME

(71) Applicant: TOSHIBA TEC KABUSHIKI KAISHA, Tokyo (JP)

(72) Inventors: Ryutaro Kusunoki, Mishima Shizuoka (JP); Shuhei Yokoyama, Mishima Shizuoka (JP); Meng Fei Wong, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/176,265

(22) Filed: Jun. 8, 2016

(65) Prior Publication Data

US 2016/0355014 A1 Dec. 8, 2016

(30) Foreign Application Priority Data

Jun. 8, 2015 (JP) ..... 2015-116080

(51) Int. Cl.
*B41J 2/14* (2006.01)
*B41J 2/045* (2006.01)

(52) U.S. Cl.
CPC ..... *B41J 2/14201* (2013.01); *B41J 2/04581* (2013.01); *B41J 2/04588* (2013.01); *B41J 2/14298* (2013.01); *B41J 2202/15* (2013.01)

(58) Field of Classification Search
CPC ..... B41J 2/14201; B41J 2/04588; B41J 2/04581; B41J 2202/15; B41J 2/14233; B41J 2/14298
See application file for complete search history.

(56) References Cited

U.S. PATENT DOCUMENTS 6,464,315 B1 * 10/2002 Otokita ..... B41J 2/04581 347/11
8,801,147 B2 8/2014 Kusunoki et al.
(Continued)

FOREIGN PATENT DOCUMENTS

JP 2004314612 A 11/2004
JP 2013-074590 A 4/2013
JP 2014172292 A 9/2014

OTHER PUBLICATIONS

Notification of Reasons for Refusal issued in case JP2015-116080 dated Jan. 9, 2018.

(Continued)

*Primary Examiner* — Geoffrey Mruk
(74) *Attorney, Agent, or Firm* — Patterson & Sheridan, LLP

(57) ABSTRACT

An ink jet head includes a pressure chamber connected to a nozzle, an actuator configured to cause liquid in the pressure chamber to be ejected from the nozzle by deforming a wall of the pressure chamber, and a drive circuit configured to apply voltage to the actuator to drive the actuator. When a droplet of the liquid is ejected from the nozzle, the voltage applied to the actuator is changed from a first value to a second value that causes the pressure chamber to expand, and then changed from a third value that is equal to the second value or between the first value and the second value to the first value after a time period λ, which is a primary natural oscillation period of the actuator when the pressure chamber and the nozzle are filled with the liquid.

20 Claims, 9 Drawing Sheets

(56) References Cited

U.S. PATENT DOCUMENTS

| | | | |
|---|---|---|---|
| 8,888,217 | B2 | 11/2014 | Nishikawa et al. |
| 9,073,319 | B2 | 7/2015 | Kusunoki et al. |
| 2003/0001912 | A1 | 1/2003 | Kusunoki |
| 2013/0222484 | A1 | 8/2013 | Yokohama et al. |
| 2013/0271530 | A1 | 10/2013 | Yokohama et al. |
| 2015/0298458 | A1 | 10/2015 | Yokohama et al. |

OTHER PUBLICATIONS

Japanese Office Action filed Jul. 10, 2018 in counterpart Japanese Patent Application No. 2015-116080 (9 pages) (with machine translation).

* cited by examiner

INK JET HEAD AND INK JET APPARATUS HAVING THE SAME

CROSS-REFERENCE TO RELATED APPLICATION

This application is based upon and claims the benefit of priority from Japanese Patent Application No. 2015-116080, filed Jun. 8, 2015, the entire contents of which are incorporated herein by reference.

FIELD

Exemplary embodiments described herein relate generally to an ink jet head and an ink jet apparatus having the same.

BACKGROUND

An ink jet head typically includes a piezoelectric actuator on a wall of a pressure chamber having a nozzle. To eject ink in the pressure chamber from the nozzle, the actuator deforms the pressure chamber and pressurizes the ink in the pressure chamber.

In addition, to form an image employing an inkjet head including a piezoelectric actuator, droplets of ink are successively ejected from the nozzle to a same pixel, so that the droplets adhere to each other and form a dot on a recording medium, and the size of the dot is differentiated by controlling the number of the droplets.

Conventionally, the inkjet head has the nozzle disposed through the actuator, and a length of the nozzle is substantially the same as a thickness of the actuator.

DETAILED DESCRIPTION

Figure 1:
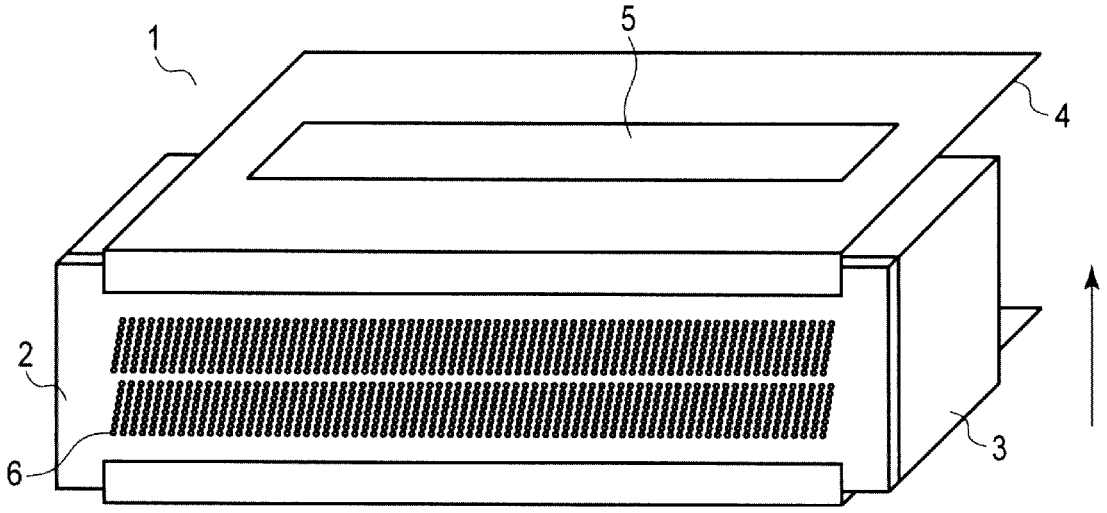
FIG. 1 is a perspective view of an ink jet head according to an embodiment.

Since a nozzle is provided on an actuator in an ink jet head of the related art, the length of the nozzle is the same as the thickness of the actuator. Since it is desirable for the thickness of the actuator to be thin from the perspective of drive efficiency, the length of the nozzle is also restricted.

Since the length of the nozzle is short, there is a problem in that, when the ejection speed of the ink which is ejected from the nozzle is increased, the ink is unintentionally ejected immediately after ejecting the ink, and print quality is reduced. When the ejection speed of the ink is suppressed in order to prevent the problem, the unintentional ejection of ink may be prevented; however, there is a problem in that the position at which the ink which is ejected from the nozzle adheres to the recording medium varies easily and, after all, the print quality is reduced.

One or more embodiments disclosed herein provide an ink jet head that performs ejection of liquid by a desired amount at a desired location, and an ink jet apparatus having the ink jet head.

In general, according to an embodiment, an ink jet head cancels out ink pressure fluctuation at the same time as ink ejection is completed to prevent unexpected ejection of the ink after the ink ejection by first expanding a volume of a pressure chamber using an actuator, introducing the ink into the pressure chamber from an ink supply path by reducing the pressure of the ink, allowing the ink pressure to rise spontaneously due to the pressure fluctuation to eject the ink from a nozzle, and decreasing the volume of the pressure chamber using the actuator at a timing at which the ink pressure is reduced after the ejection of the ink is completed to pressurize the ink.

Specifically, an inkjet head includes a pressure chamber connected to a nozzle, an actuator configured to cause liquid in the pressure chamber to be ejected from the nozzle by deforming a wall of the pressure chamber, and a drive circuit configured to apply voltage to the actuator to drive the actuator. When a droplet of the liquid is ejected from the nozzle, the voltage applied to the actuator is changed from a first value to a second value that causes the pressure chamber to expand, and then changed from a third value that is equal to the second value, or between the first value and the second value, to the first value after a time period $\lambda$, which is a primary natural oscillation period of the actuator when the pressure chamber and the nozzle are filled with the liquid.

Hereinafter, the embodiments will be described with reference to the drawings. Each of the drawings is used for facilitating understanding of an embodiment, and although some elements in the drawings are different from actual elements in shapes, dimensions, ratios and the like, the design thereof may be changed as appropriate.

FIG. 1 is a perspective view of an ink jet head 1 according to an embodiment.

The ink jet head 1 includes a flow path substrate 2, an ink supply unit 3, a flexible wiring board 4, and a drive circuit 5.

Actuators 6 have nozzles 17 (illustrated in FIG. 3), which eject ink, arranged in an array formation on the flow path substrate 2. The nozzles 17 do not overlap each other in a print direction, and are arranged at an equal interval in a direction perpendicular to the print direction. Each of the actuators 6 is electrically connected to the drive circuit 5 via the flexible wiring board 4. The drive circuit 5 is electrically connected to a control circuit (not illustrated in the drawings) which performs print control. The flow path substrate 2 and the flexible wiring board 4 are bonded in a state of being electrically connected through an anisotropic conductive film (ACF). For example, the flexible wiring board 4 and the drive circuit 5 are bonded in a state of being electrically connected through chip on flex (COF).

The ink supply unit 3 includes an ink supply port (not illustrated in the drawings) which connects to a tube or the like, and supplies the ink through the ink supply port to the flow path substrate 2. The flow path substrate 2 and the ink supply unit 3 are bonded using an epoxy-based adhesive, for example.

The ink is supplied from the ink supply port, and when the drive circuit 5 transmits an electrical signal (also referred to as a drive signal) to the actuator 6, the actuator 6 causes the pressure chamber 18 (illustrated in FIG. 3) of the flow path substrate 2 to vibrate, and the ink is ejected from the nozzle 17 which is provided in a direction perpendicular to the surface of the flow path substrate 2. In other words, the drive circuit 5 supplies an electrical signal to the actuator 6. The actuator 6 causes the volume of the pressure chamber 18 to change according to the electrical signal to generate vibration of the ink. As a result, the nozzle 17 ejects the ink from the pressure chamber 18.

The pressure of the ink supplied to the ink supply port is desirably approximately 1,000 Pa lower than the atmospheric pressure.

Figure 2:
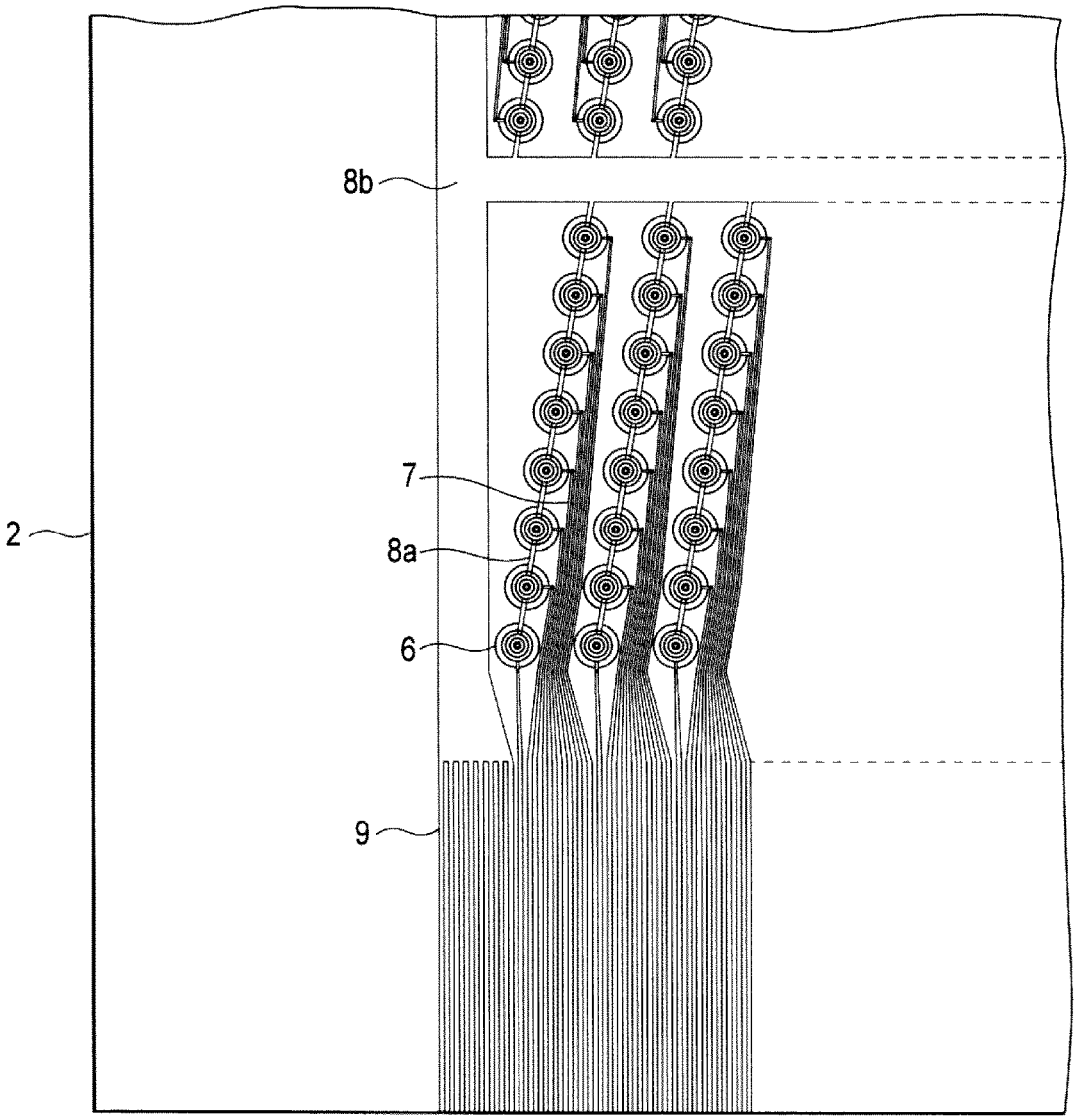
FIG. 2 is a detailed plan view of a flow path substrate of the ink jet head.

FIG. 2 is a plan view of the flow path substrate 2 in detail. Some of patterns formed on the flow path substrate 2 are omitted because these are same as the ones depicted in FIG. 2.

The multiple actuators 6, multiple individual electrodes 7, common electrodes 8*a* and 8*b*, and multiple mounting pads 9 are formed on the flow path substrate 2. The common electrode 8*a* or the common electrode 8*b* may be simply referred to as a common electrode 8.

The individual electrodes 7 electrically connect each of the actuators 6 to a corresponding mounting pad 9. The individual electrodes 7 are electrically isolated from each other.

The common electrode 8*b* is electrically connected to the mounting pads 9 of the end portion. The common electrode 8*a* branches from the common electrode 8*b* and is electrically connected to the plurality of actuators 6. The common electrodes 8*a* and 8*b* are connected to the plurality of actuators 6.

The mounting pads 9 are electrically connected to the drive circuit 5 via multiple wiring patterns which are formed on the flexible wiring board 4. Anisotropic conductive film (ACF) may be used for the connections between the mounting pads 9 and the flexible wiring board 4. In addition, the mounting pads 9 may be connected to the drive circuit 5 using a method such as the wire bonding.

Figure 3:
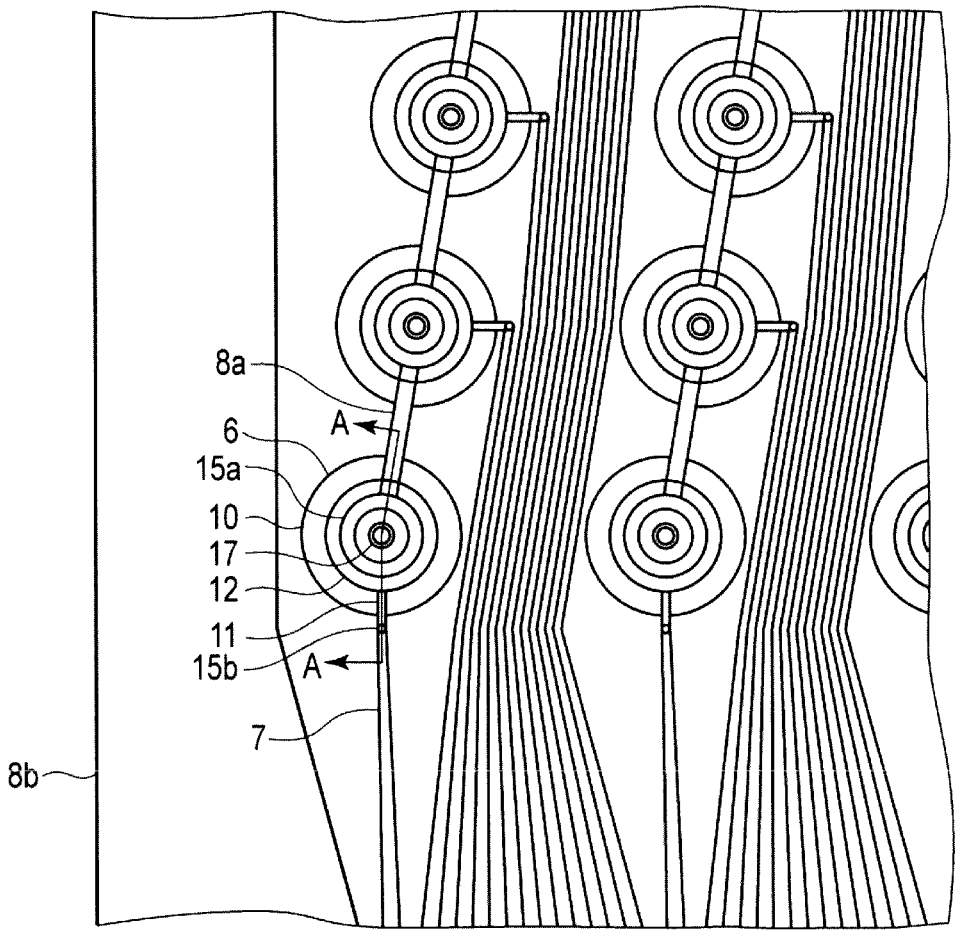
FIG. 3 is another detailed plan view of the flow path substrate.
Figure 4:
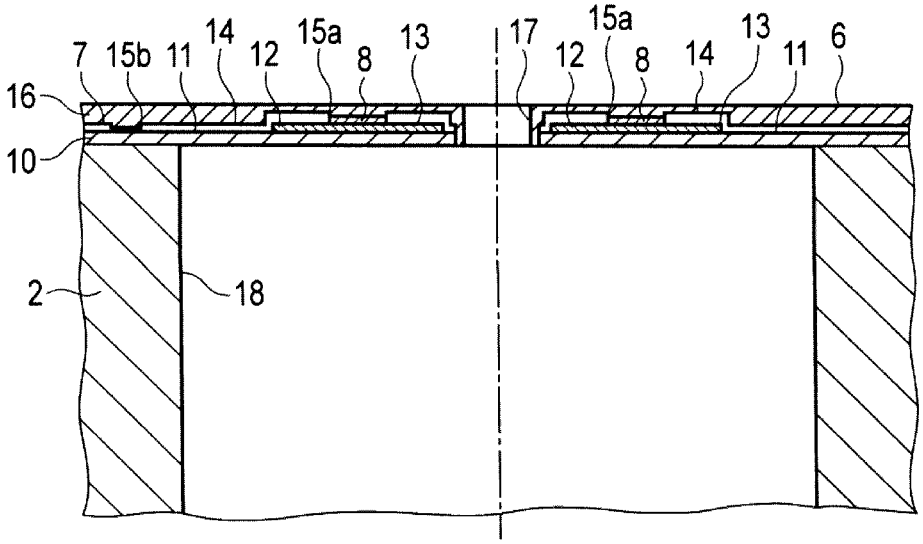
FIG. 4 is a cross-sectional diagram of the flow path substrate taken along line IV-IV of FIG. 3.

FIG. 3 is a plan view of actuators 6 of the flow path substrate 2. FIG. 4 is a cross-sectional diagram of the flow path substrate 2 taken along line A-A of FIG. 3.

The actuator 6 includes a diaphragm 10, a bottom electrode 11, a piezoelectric element 12, a top electrode 13, an insulating layer 14, a common electrode 8, a protective layer 16, and a nozzle 17. The bottom electrode 11 is electrically connected to the individual electrode 7.

The flow path substrate 2 is formed of a single crystal silicon wafer with a thickness of 500 μm, for example. The pressure chamber 18, in which the ink is stored, is formed in an inner portion of the flow path substrate 2. The diameter of the pressure chamber 18 is 200 μm, for example. The pressure chamber 18 is formed by opening a hole by dry etching from the bottom surface of the flow path substrate 2.

The diaphragm 10 is formed integrally with the flow path substrate 2 to cover the top surface of the pressure chamber 18. The diaphragm 10 is formed of silicon dioxide by heating the flow path substrate 2 at high temperature before forming the pressure chamber 18. A through hole which is larger than the nozzle 17 is formed in the diaphragm 10 in the shape of a circle which is coaxial with the nozzle 17. The thickness of the diaphragm 10 is set as 4 μm, for example.

The bottom electrode 11, the piezoelectric element 12, and the top electrode 13 are formed on the diaphragm 10 in a donut shape around the nozzle 17. The inner diameter is set as 30 μm, for example, and the outer diameter is set as 140 μm, for example. For example, the bottom electrode 11, the piezoelectric element 12, and the top electrode 13 are formed of films of platinum, lead zirconate titanate (PZT), and platinum, respectively, using the sputtering method. The thickness of the top electrode 13 and the bottom electrode 11 is 0.1 μm to 0.2 μm, for example. The thickness of the PZT is 2 μm, for example. The PZT film may also be formed using a sol-gel method or the like.

The insulating layer 14 is formed on the top electrode 13. Contact holes 15*a* and 15*b* are formed in the insulating layer 14. The contact hole 15*a* is a donut-shaped opening through which the top electrode 13 is electrically connected to the common electrode 8. The contact hole 15*b* is a circular opening through which the bottom electrode 11 is electrically connected to the individual electrode 7. The insulating layer 14 is silicon dioxide formed by a tetraethoxysilane chemical vapor deposition (TEOS-CVD) method, for example. The thickness of the insulating layer 14 is 0.5 μm, for example. The insulating layer 14 prevents the common electrode 8 and the bottom electrode 11 from being electrically connected to each other at the outer circumferential portion of the piezoelectric element 12.

The individual electrode 7, the common electrode 8, and the mounting pad 9 are formed on the insulating layer 14. The individual electrode 7 is connected to the bottom electrode 11, and the common electrode 8 is connected to the top electrode via the contact holes 15*b* and 15*a*, respectively. Alternatively, the individual electrode 7 may be connected to the top electrode 13, and the common electrode 8 may be connected to the bottom electrode 11. The individual electrode 7, the common electrode 8, and the mounting pad 9 may be formed by sputter depositing a gold film to a thickness of 0.1 μm to 0.5 μm, for example.

The protective layer 16 is formed on the individual electrode 7, the common electrode 8, and the insulating layer 14. The nozzle 17 which communicates with the pressure chamber 18 is formed in the protective layer 16. The thickness of the protective layer 16 is 4 μm, for example, and the diameter of the nozzle 17 is 20 μm, for example. The protective layer 16 is formed by coating a photosensitive polyimide material using a spin coating method, for example. The nozzle 17 is formed by exposing and developing the photosensitive polyimide material which forms the protective layer 16, for example.

The length of the nozzle 17 is determined by the sum of the thickness of the diaphragm 10 and the thickness of the protective layer 16. In the present example, the length of the nozzle 17 is 8 μm, for example. Since the length of the nozzle 17 is extremely short, when residual pressure vibrations remain in the ink in the pressure chamber 18 after the ink ejection operation, an ink droplet may be unintentionally ejected from the nozzle 17, which leads to degradation of print quality.

Next, operations of the ink jet head 1 according to the present embodiment will be described using several examples.

First Example

Figure 5:
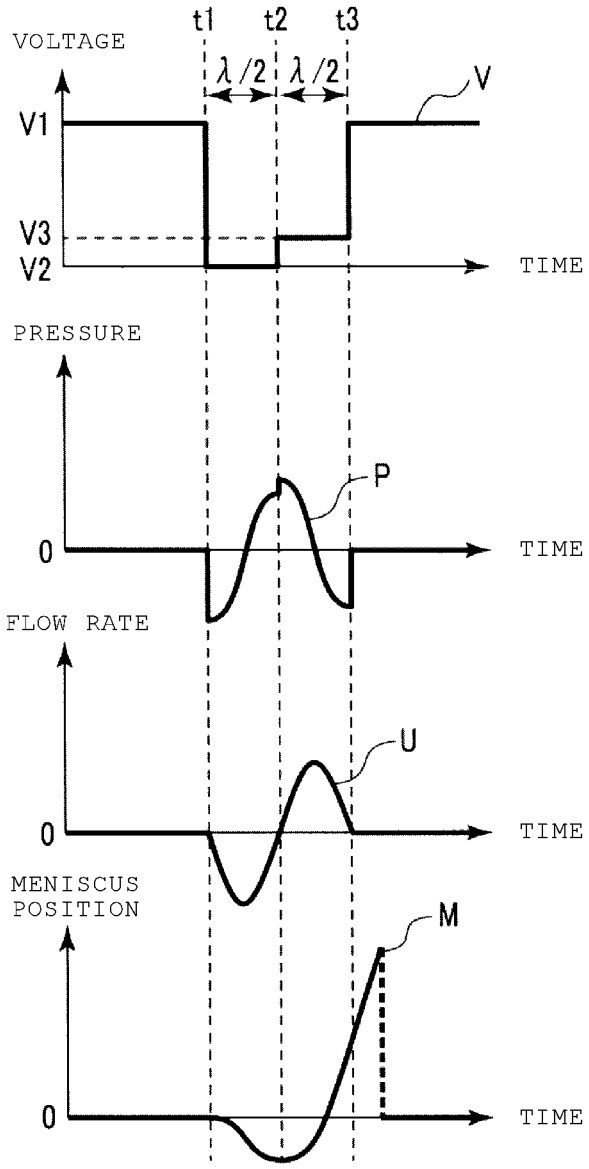
FIG. 5 illustrates change of a voltage applied to an actuator of the ink jet head, a pressure of ink in a nozzle of the ink jet head, a flow rate of the ink, and a meniscus position of the ink, with respect to passage of time according to a first example.

FIG. 5 illustrates values of an electrical signal V which the drive circuit 5 applies to the individual electrode 7, a pressure P of the ink in the pressure chamber 18, a flow rate U of the ink in the nozzle 17, and a meniscus position M of the ink in the nozzle 17, in relation to passage of time, according to a first example. The flow rate U is defined as positive, greater than 0, in the ink ejection direction. The meniscus position M is defined as 0 at the opening surface of an outer edge of the nozzle 17. The meniscus position is defined as positive, greater than 0, in the ink injecting direction, in other words on the ink ejecting side (or outer side), and is negative on the pressure chamber 18 side. The voltage of the common electrode 8 is fixed at 0 V.

A time λ is defined as a primary natural oscillation period of the actuator 6 in a state in which the pressure chamber 18 and the nozzle 17 are filled with the ink. The pressure P and the flow rate U of the ink in the pressure chamber 18 or the nozzle 17 fluctuate at the primary natural oscillation period λ.

The primary natural oscillation period λ may be measured by measuring the impedance of the actuator 6, using a commercial impedance analyzer such as the 4294A manufactured by Agilent Technologies, when the ink jet head 1 is filled with ink. Alternatively, the primary natural oscillation period λ may also be measured by measuring the vibration of the actuator 6, using a commercial laser Doppler vibrometer, when an electrical signal with a step waveform or the like is output from the drive circuit 5.

The ink jet head 1 is ready for ink ejection when ink is charged from the ink supply port (not illustrated in the drawings) of the ink supply unit 3, the pressure chamber 18 and the nozzle 17 are filled with ink from the ink supply unit 3, and the pressure of the ink in the pressure chamber 18 is maintained at a value approximately 1,000 Pa lower than the atmospheric pressure. In this state, the meniscus position M of the ink in the nozzle 17 is maintained at a value approximately 0.

In a ready state, prior to a start time t1 of an ink ejection operation, the electrical signal V is maintained at a voltage V1. The voltage V1 is applied between the bottom electrode 11 and the top electrode 13, resulting in an electric field in the thickness direction of the piezoelectric element 12. D31 mode deformation is caused in the piezoelectric element 12, and the piezoelectric element 12 contracts in a direction perpendicular to the thickness direction. A compressive stress is generated in the diaphragm 10 and the protective layer 16 due to the contraction of the piezoelectric element 12. Since the Young's modulus of the diaphragm 10 is greater than the Young's modulus of the protective layer 16, the compressive force in the diaphragm 10 is greater than the compressive force in the protective layer 16. Therefore, the actuator 6 curves in the direction of the pressure chamber 18, and the volume of the pressure chamber 18 is reduced relative to a state in which the voltage V1 is not applied. In other words, as the value of the electrical signal V increases, the volume of the pressure chamber 18 decreases due to the effect of the actuator 6.

The ink ejection operation is started at the time t1. The electrical signal V changes from the ready state voltage V1 to a voltage V2 lower than the voltage V1. The voltage V2 is preferably 0 V, or slightly negative (i.e. opposite in sign to the voltage V1), or the same sign as the voltage V1. Accordingly, the voltage V2 increases the volume of the pressure chamber 18 more than the voltage V1. If V2 has a large negative value, the polarization direction of the piezoelectric element 12 can become inverted with respect to the ready state and the desired operation may not be obtained.

When the electrical signal V changes from the voltage V1 to the voltage V2, the actuator 6 is deformed in the direction which expands the volume of the pressure chamber 18.

When the volume of the pressure chamber 18 increases, the pressure P of the ink in the pressure chamber 18 is reduced, and the meniscus position M of the ink in the nozzle 17 withdraws towards the pressure chamber 18 (i.e. in the negative direction of meniscus position M). When the pressure is reduced, ink is supplied from the ink supply unit 3 to the pressure chamber 18, equalizing the pressure P.

When a time of λ/2 elapses from the time t1 and the time t2 is reached, the increase of the pressure P stops. The meniscus position M of the ink stops withdrawing.

At this timing, the voltage of the electrical signal V is changed from V2 to V3 or maintained at V2 if V2=V3. The voltage V3 is greater than or equal to the voltage V2 and is lower than the voltage V1. The actuator 6 is deformed in the direction of the pressure chamber 18, and the ink of the pressure chamber 18 is further pressurized. The meniscus position M of the ink starts proceeding in the ejection (i.e., positive) direction, and the ink is ejected from the nozzle 17. The ejection of the ink continues for the time of λ/2. During the ejection, the pressure P declines.

When the time of λ/2 elapses from the time t2 and the time t3 is reached, the pressure P becomes a minimum pressure. The flow rate U of the ink in the nozzle 17 becomes 0 and the ejection stops. However, the ink which has already exited from the nozzle 17 forms a droplet and separates from the meniscus.

At this timing, the voltage of the electrical signal V is changed from V3 to V1. The actuator 6 is deformed in the direction of the pressure chamber 18, the pressure P of the ink of the pressure chamber 18 changes from a negative value to approximately 0, and the vibration of the ink stops. In this manner, the vibration of the ink which is caused at the time t1 is canceled out by the deformation of the actuator 6 at the time t3 and stops. Therefore, at the time t3, the pressure P and the flow rate U become 0.

Even after the time t3, the ink droplet ejected from the nozzle 17 continues to fly toward the recording medium. In accordance with the flight of the ink droplet, the tail of the ink droplet is spontaneously severed from the ink in the nozzle 17, and an ink meniscus is reformed at the meniscus position of approximately 0.

The voltage V3 is determined according to the attenuation rate of the pressure vibration P or the flow rate vibration U of the ink. The attenuation rate of the pressure vibration P and the attenuation rate of the flow rate vibration U are the same value. The attenuation rate may be obtained at the same time as the measurement of the primary natural oscillation period λ. When the attenuation rate is high, the ratio of the voltage (V1−V3) to the voltage (V1−V2) is set to be small. In other words, the voltage V3 is set to be high. When the attenuation rate is low, the ratio of the voltage (V1−V3) to the voltage (V1−V2) is set to be large. In other words, the voltage V3 is set to be low. The voltage V3 is adjusted such that, after the time t3, the pressure P or the flow rate vibration U becomes the minimum or approximately 0. When the attenuation rate is low, the attenuation rate may be treated as 0 and the voltage V3 may be set to be equal to the voltage V2.

As described above, the value of the electrical signal V varies among the first voltage V1, the second voltage V2 which increases the volume of the pressure chamber 18 more than the first voltage V1, and the third voltage V3 which is between the first voltage V1 and the second voltage V2 or is equal to the second voltage V2. A single ink droplet is ejected from the nozzle 17 by changing the value of the electrical signal V from the first voltage V1 to the second voltage V2, and by changing from the third voltage V3 to the first voltage V1 after a time period λ elapses. The value of the electrical signal V changes from the first voltage V1 to the second voltage V2, remains at the second voltage V2 for a time period of λ/2, and then changes from the second voltage V2 to the third voltage V3, remaining at the third voltage V3 for a time period of λ/2.

In this manner, since fluctuation of the pressure P and the flow rate U of the ink stop immediately after the ink ejection from the nozzle 17, ink may be prevented from unintentionally being ejected from the nozzle 17 due to residual vibrations of the ink after the ink ejection operation even the nozzle 17 is provided on an actuator 6 and ink tends to be unintentionally ejected from the nozzle 17.

Conventionally, when the ink meniscus is reformed at a position closer to the pressure chamber 18 than the position in the ready state, the ink meniscus proceeds in the ink ejection direction due to the surface tension or the like of the ink, and the ink can be unintentionally ejected from the nozzle 17. According to the present embodiment, however, since the ink meniscus is reformed at a position approximately at the ready state position before the ink ejection operation, the ink meniscus is substantially in a stationary state, and ink may be prevented from being unintentionally ejected from the nozzle 17 even the nozzle 17 is provided on an actuator band ink tends to be unintentionally ejected from the nozzle 17.

Second Example

Figure 6:
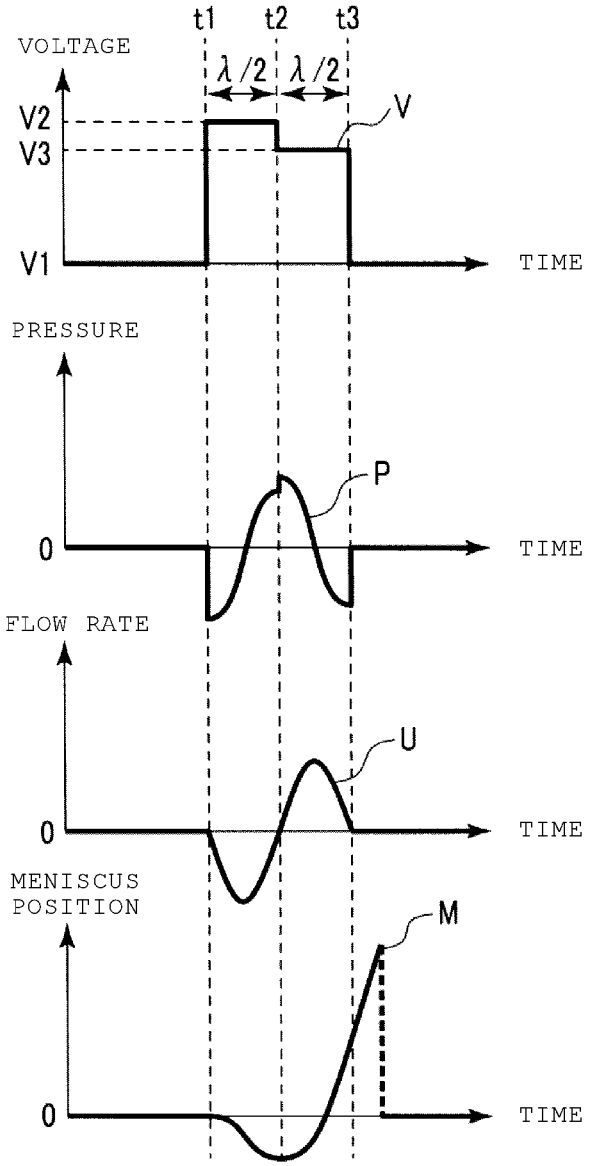
FIG. 6 illustrates change of a voltage applied to an actuator of the ink jet head, a pressure of ink in a nozzle of the ink jet head, a flow rate of the ink, and a meniscus position of the ink, with respect to passage of time according to a second example.

FIG. 6 illustrates the values of the electrical signal V, and the pressure P, the flow rate U, and the meniscus position M of the ink according to a second example in the same manner as in the first example. In the second example, the voltage V1 is 0 V. The voltage of the common electrode 8 is fixed at V2. Hereinafter, description will be focused on portions which are different from the first example.

When a voltage is applied between the bottom electrode 11 and the top electrode 13, the actuator 6 is deformed towards the pressure chamber 18, and the volume of the pressure chamber 18 becomes smaller than that in a state in which no voltage is applied. Therefore, as the value of the electrical signal V increases, the volume of the pressure chamber 18 increases due to the effect of the actuator 6.

The electrical signal V maintains the relationship of the voltage V1=0 V in the ready state prior to the start timing t1 of the ink ejection operation. The value of the electrical signal V changes from the voltage V1 to a voltage V2 at the time t1. The voltage V2 is higher than the voltage V1. When the time period of λ/2 elapses from the time t1 and the time t2 is reached, the value of the electrical signal V changes from the voltage V2 to the voltage V3. The voltage V3 is equal to or lower than the voltage V2 and is higher than the voltage V1. As described in the first example, the voltage V3 may be equal to the voltage V2. When the time period of λ/2 elapses from the time t2 and the time t3 is reached, the value of the electrical signal V changes from the voltage V3 to the voltage V1.

Since the absolute value of the potential difference between the top electrode 13 and the bottom electrode 11 is the same as in the first example, the operation of the piezoelectric element 12 is the same as in the first example. Therefore, the change of the pressure P, the flow rate U, and the meniscus position M are the same as the change of the pressure P, the flow rate U, and the meniscus position M in the first example, respectively.

As described above, values of the electrical signal V includes the first voltage V1, the second voltage V2 which increases the volume of the pressure chamber 18 more than the first voltage V1, and the third voltage V3 which is between the first voltage V1 and the second voltage V2 or is equal to the second voltage V2. A single ink droplet is ejected from the nozzle 17 by changing the value of the electrical signal V from the first voltage V1 to the second voltage V2, and by changing from the third voltage V3 to the first voltage V1 after the time period λ. The value of the electrical signal V changes from the first voltage V1 to the second voltage V2, and remains at the second voltage V2 for a time period of λ/2, and changes from the second voltage V2 to the third voltage V3. The value of the electrical signal V changes from the second voltage V2 to the third voltage V3, and remains at the third voltage V3 for a time period of λ/2. Since the operation of the second example is the same as in the first example, description thereof will be omitted.

Third Example

Figure 7:
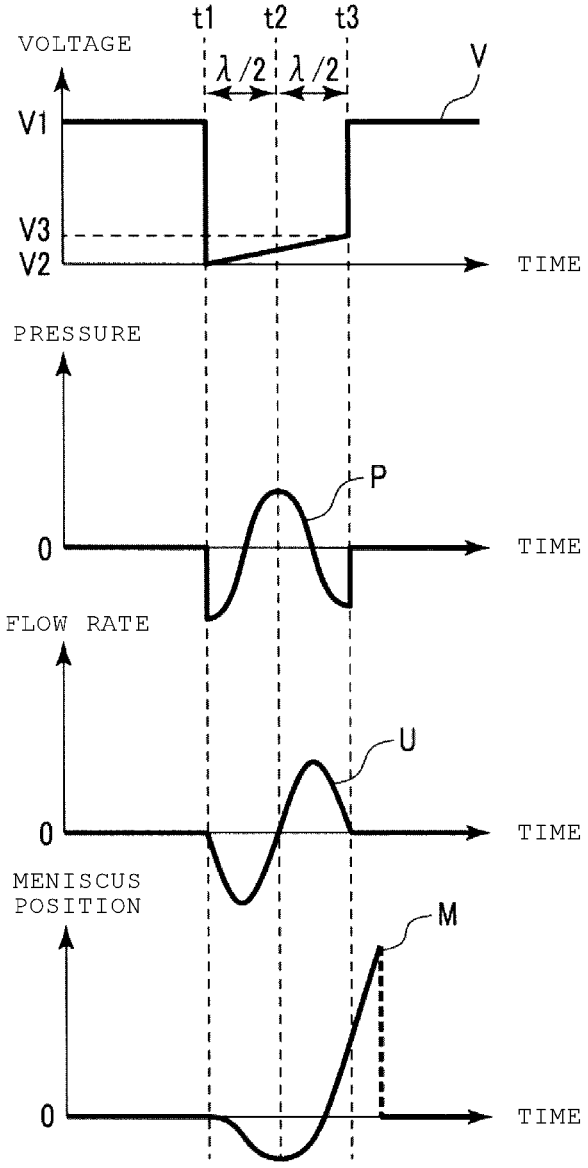
FIG. 7 illustrates change of a voltage applied to an actuator of the ink jet head, a pressure of ink in a nozzle of the ink jet head, a flow rate of the ink, and a meniscus position of the ink, with respect to passage of time according to a third example.

FIG. 7 illustrates values of the electrical signal V, the pressure P, the flow rate U, and the meniscus position M of the ink according to a third example in the same manner as in the first example. The voltage of the common electrode 8 is fixed at 0 V in the same manner as in the first example. Hereinafter, description will be focused on portions which are different from the first example.

When the value of the electrical signal V changes from the voltage V1 to the voltage V2 at the time t1, the diaphragm 10 is deformed so as to increase the volume of the pressure chamber 18.

When the volume of the pressure chamber 18 increases, the pressure P of the ink in the pressure chamber 18 is reduced, and the meniscus position M of the ink in the nozzle 17 withdraws towards the pressure chamber 18. The ink is supplied from the ink supply unit 3 to the pressure chamber 18. Although the pressure P is temporarily reduced, the pressure P subsequently increases for that reason.

From the time t1 until the time t3, the value of the electrical signal V continually increases from the voltage V2 to the voltage V3. In accordance with the voltage rise, the pressure chamber 18 gradually contracts. However, since the change rate of the volume of the pressure chamber 18 is low, the fluctuation of the pressure P and the flow rate U caused by the contraction is small, and may be ignorable.

When a time period of λ/2 elapses from the time t1 and the time t2 is reached, the increase of the pressure P stops. Also, the meniscus position M of the ink stops withdrawing.

The meniscus position M of the ink starts proceeding in the ejection direction, and the ink is ejected from the nozzle 17. The ejection of the ink continues for the time period of λ/2. During the ejection, the pressure P keeps declining.

When the time period of λ/2 elapses from the time t2 and the time t3 is reached, the pressure P reaches the minimum pressure. The flow rate U of the ink in the nozzle 17 becomes 0 and the ejection stops. However, the ink which has already exited from the nozzle 17 forms a droplet and continues to fly.

At this timing, the value of the electrical signal V is changed from V3 to V1. The actuator 6 is deformed towards the pressure chamber 18, the pressure P of the ink in the pressure chamber 18 increases from a negative pressure value to approximately 0, and the flow rate U of the ink stops decreasing. In this manner, the vibration of the ink which is caused at the time t1 is canceled out by the deformation of the actuator 6 at the time t3 and stops. Therefore, at the time t3, the pressure P and the flow rate U become 0.

Even after the time t3, the ink droplet ejected from the nozzle 17 continues to fly toward the recording medium. In accordance with the flight of the ink droplet, the tail of the ink droplet is spontaneously severed from the ink in the nozzle 17, and an ink meniscus is reformed at the meniscus position approximately 0.

As described above, the values of the electrical signal V varies among the first voltage V1, the second voltage V2 which increases the volume of the pressure chamber 18 more than the first voltage V1, and the third voltage V3 which is between the first voltage V1 and the second voltage V2 or is equal to the second voltage V2. A single ink droplet is ejected from the nozzle 17 by changing the value of the electrical signal V from the first voltage V1 to the second voltage V2, and by changing from the third voltage V3 to the first voltage V1 after the time period of λ. The value of the electrical signal V changes from the first voltage V1 to the second voltage V2, and gradually changes from the second voltage V2 to the third voltage V3 throughout the time period of λ.

In this manner, even in the third example, the ink may be prevented from being unintentionally ejected from the nozzle 17 due to residual vibrations of the ink after the ink ejection operation even the nozzle 17 is provided on an actuator 6 and ink tends to be unintentionally ejected from the nozzle 17.

Since the ink meniscus is reformed at a position approximate to the position of the ink in the ready state before the ink ejection operation, the ink meniscus substantially becomes in a stationary state, and ink may be prevented from being unintentionally ejected from the nozzle 17 even the nozzle 17 is provided on an actuator 6 and ink tends to be unintentionally ejected from the nozzle 17.

The value of the voltage V3 is determined according to the attenuation rate of the pressure P or the flow rate U of the ink in the same manner as in the first example.

Also in the second example described above, from the time t1 until the time t3, the electrical signal V may be caused to continually fall from the voltage V2 to the voltage V3. Since the operation in this case is the same as the operation of the third example described above, description will be omitted.

Fourth Example

Figure 8:
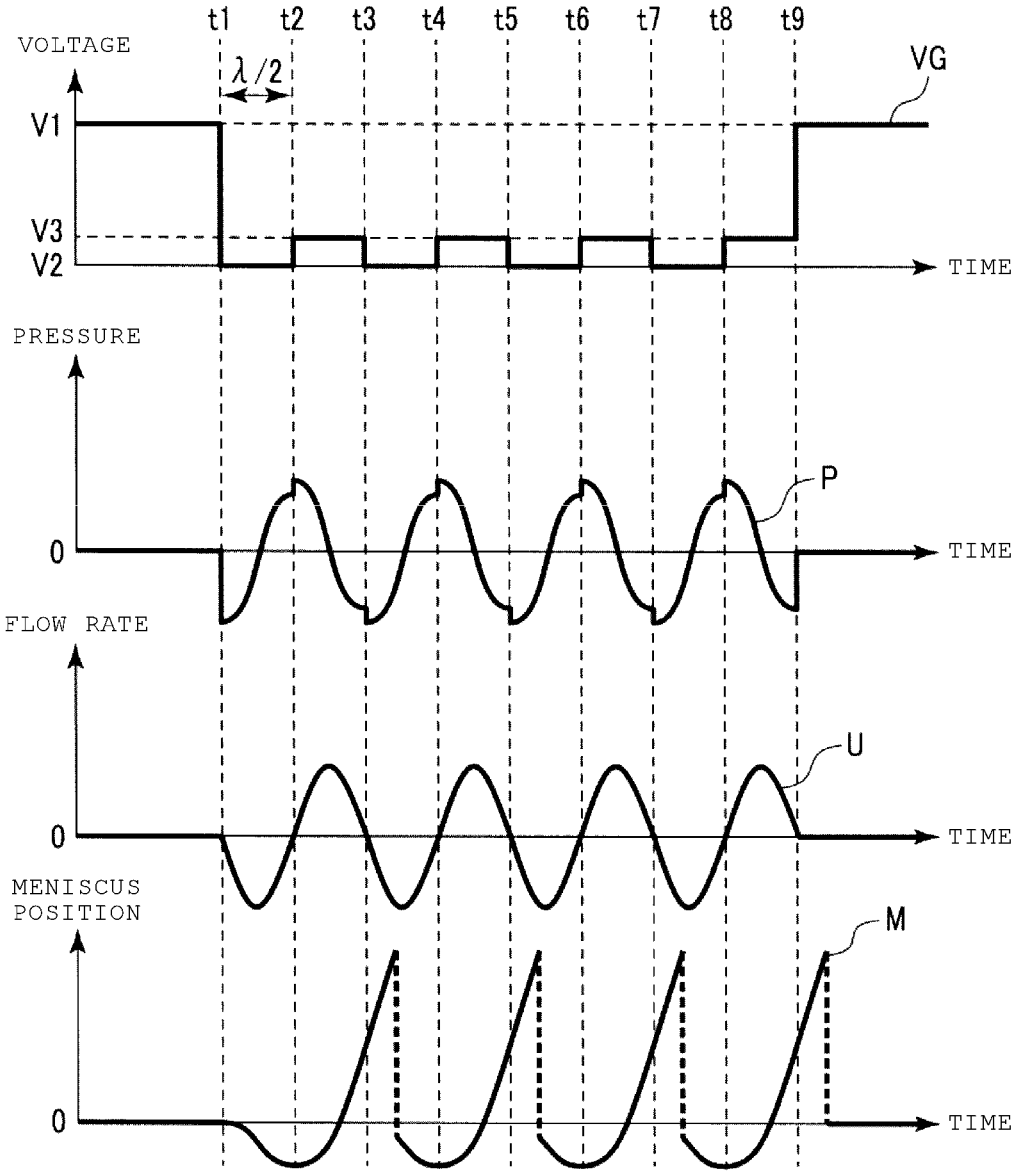
FIG. 8 illustrates change of a voltage applied to an actuator of the ink jet head, a pressure of ink in a nozzle of the ink jet head, a flow rate of the ink, and a meniscus position of the ink, with respect to passage of time according to a fourth example.

FIG. 8 illustrates values of an electrical signal VG which the drive circuit 5 applied to the individual electrode 7, the pressure P of the ink in the pressure chamber 18, the flow rate U of the ink in the nozzle 17, and the meniscus position M of the ink in the nozzle 17 according to a fourth example. The voltage of the common electrode 8 is fixed at 0 V. Description which is the same as the first example will be omitted.

The fourth example is an example in which the operation to change the value of the electrical signal V of the first example is repeated four times. Accordingly, the nozzle 17 successively ejects an ink droplet four times. The operation to change the value of the electrical signal VG may be repeated a plurality of times, as necessary, other than four times. The ejected ink droplets land on the same pixel of the recording medium. The number of times of ejecting the ink droplets is controlled by changing the number of times of repeating the changes of the electrical signal V, and the size of the dot to be formed on the pixel of the recording medium may be controlled. Accordingly, gradation printing may be performed.

The electrical signal VG is maintained at the voltage V1 during the ready state prior to the start timing t1 of the ink ejection operation.

In this state, the value of the pressure chamber 18 is maintained to be smaller than that in a state in which the voltage V1 is not applied. In other words, as the value of the electrical signal VG increases, the volume of the pressure chamber 18 decreases due to the effect of the actuator 6.

The ink ejection operation is started at the time t1. The value of the electrical signal VG changes from the voltage V1 to the voltage V2.

The voltage V2 is lower than the voltage V1. The voltage V2 is a voltage which increases the volume of the pressure chamber 18 more than the voltage V1, and is preferably 0 V or slightly negative.

When the value of the electrical signal VG changes from the voltage V1 to the voltage V2, the actuator 6 is deformed in the direction that increases the volume of the pressure chamber 18.

When the volume of the pressure chamber 18 increases, the pressure P of the ink in the pressure chamber 18 is reduced, and the meniscus position M of the ink in the nozzle 17 withdraws in the direction of the pressure chamber 18. Ink is supplied from the ink supply unit 3 to the pressure chamber 18 by effect of the temporarily reduced pressure P, which equalizes the pressure P.

When a time period of λ/2 elapses from the time t1 and the time t2 is reached, the increase of the pressure P stops. The meniscus position M of the ink stops withdrawing.

At this timing, the value of the electrical signal VG is changed from V2 to V3 or maintained at V2, if V2=V3. The voltage V3 is greater than or equal to the voltage V2 and is lower than the voltage V1. The actuator 6 is deformed towards the pressure chamber 18, and the ink in the pressure chamber 18 is further pressurized. The meniscus position M of the ink starts proceeding in the ejection direction, and the ink is ejected from the nozzle 17. The ejection of the ink continues for the time period of λ/2. During the ejection, the pressure P declines.

When the time period of λ/2 elapses from the time t2 and the time t3 is reached, the pressure P reaches the minimum pressure. The flow rate U of the ink in the nozzle 17 becomes 0 and the ejection stops. However, the ink which has already exited from the nozzle 17 forms a droplet and continues to fly.

At the time t3, the value of the electrical signal VG is changed from V3 to V2 or maintained at V2 if V2=V3. The actuator 6 is deformed in the direction to increase the volume of the pressure chamber 18, the pressure P of the ink in the pressure chamber 18 further drops from a negative pressure and becomes a value same the one when the value of the electrical signal VG changes from the voltage V1 to the voltage V2 at the time t1. In this manner, the amplitude of the fluctuation of the pressure P of the ink in the pressure chamber 18 is maintained at a fixed level due to the change in the electrical signal VG from the voltage V2 to the voltage V3 and the change from the voltage V3 to the voltage V2. Accordingly, during the period from the time t3 to a time t4, the ink in the pressure chamber 18 is replenished, and during the period from the time t4 to a time t5, the ink is ejected from the nozzle 17.

During the period from the time t5 to a time t9, the ink ejection operation is repeated two more times, and four ink droplets are ejected from the nozzle 17 in total.

When the time t9 is reached, the pressure P reaches the minimum pressure. The flow rate U of the ink in the nozzle 17 becomes 0 and the ejection stops. However, the ink which has already exited from the nozzle 17 forms a droplet and continues to fly.

At this timing, the value of the electrical signal VG is changed from V3 to V1. The actuator 6 is deformed towards the pressure chamber 18, the pressure P of the ink in the pressure chamber 18 is increased from the negative value to approximately 0, and the vibration of the ink stops.

Even after the time t9, the ink droplet ejected from the nozzle 17 continues to fly toward the recording medium. In accordance with the flight of the ink droplet, the tail of the ink droplet is spontaneously cut from the ink in the nozzle 17, and an ink meniscus is reformed at the meniscus position M of approximately 0.

The voltage V3 is set such that the ejection speed of the ink droplets which are consecutively ejected is as uniform as possible. Alternatively, the voltage V3 may be determined according to the attenuation rate of the pressure P or the flow rate U of the ink in the same manner as in the first example.

As described above, the values of the electrical signal VG include the first voltage V1, the second voltage V2 which increases the volume of the pressure chamber 18 more than the first voltage V1, and the third voltage V3 which is between the first voltage V1 and the second voltage V2 or is equal to the second voltage V2. A single ink droplet is ejected from the nozzle 17 by changing the value of the electrical signal VG from the first voltage V1 to the second voltage V2, and by changing from the third voltage V3 to the second voltage V2 after the time period of $\lambda$. This is repeated an appropriate number of times before the value of the electrical signal VG changes from the third voltage V3 to the first voltage V1.

In this manner, since the fluctuation of the pressure P and the flow rate U of the ink stop immediately after the ink ejection from the nozzle 17, ink may be prevented from unintentionally being ejected from the nozzle 17 due to residual vibration of the ink after the ink ejection operation even the nozzle 17 is provided on an actuator 6 and ink is tends to be unintentionally ejected from the nozzle 17.

Since the ink meniscus is reformed at a position approximate to the position during the ready state before the ink ejection operation, the ink meniscus becomes substantially in a stationary state, and ink may be prevented from being unintentionally ejected from the nozzle 17 even the nozzle 17 is provided on an actuator 6 and ink tends to be unintentionally ejected from the nozzle 17.

In addition to being capable of performing gradation printing and being capable of preventing the unintentional ejection of the ink from the nozzle 17, since the ejections of the second and following ink droplets are performed using the pressure fluctuation caused by the immediately previous ejection operation, electrical energy necessary for the ejection of the second and following ink droplets can be reduced.

In other words, where the electrostatic capacity between the individual electrode 7 and the common electrode 8 is C, and the voltage V2 is 0, an electrical energy E1 necessary for the ejection operation of the first ink droplet is $C\times V3^2+C\times(V1-V3)^2$; however, an electrical energy E2 necessary for the ejection operation of the second and following ink droplets is $C\times V3^2$. In most cases, since the voltage V3 is less than or equal to 50% of the voltage V1, the electrical energy E2 necessary for the ejection operation of the second and following ink droplets is less than or equal to approximately 50% of the electrical energy E1 which is necessary for the ejection operation of the first ink droplet.

Therefore, the power consumption of the ink jet head 1 can be reduced, and an operation cost of the ink jet apparatus can be reduced.

As described in the third example, the value of the electrical signal VG may be set to rise continually from the voltage V2 to the voltage V3.

The electrical signal VG may be repetition of the change of the electrical signal V of the second example. In this case, the value of the electrical signal VG may be set to fall continually from the voltage V2 to the voltage V3 as described in the third example.

Figure 9:
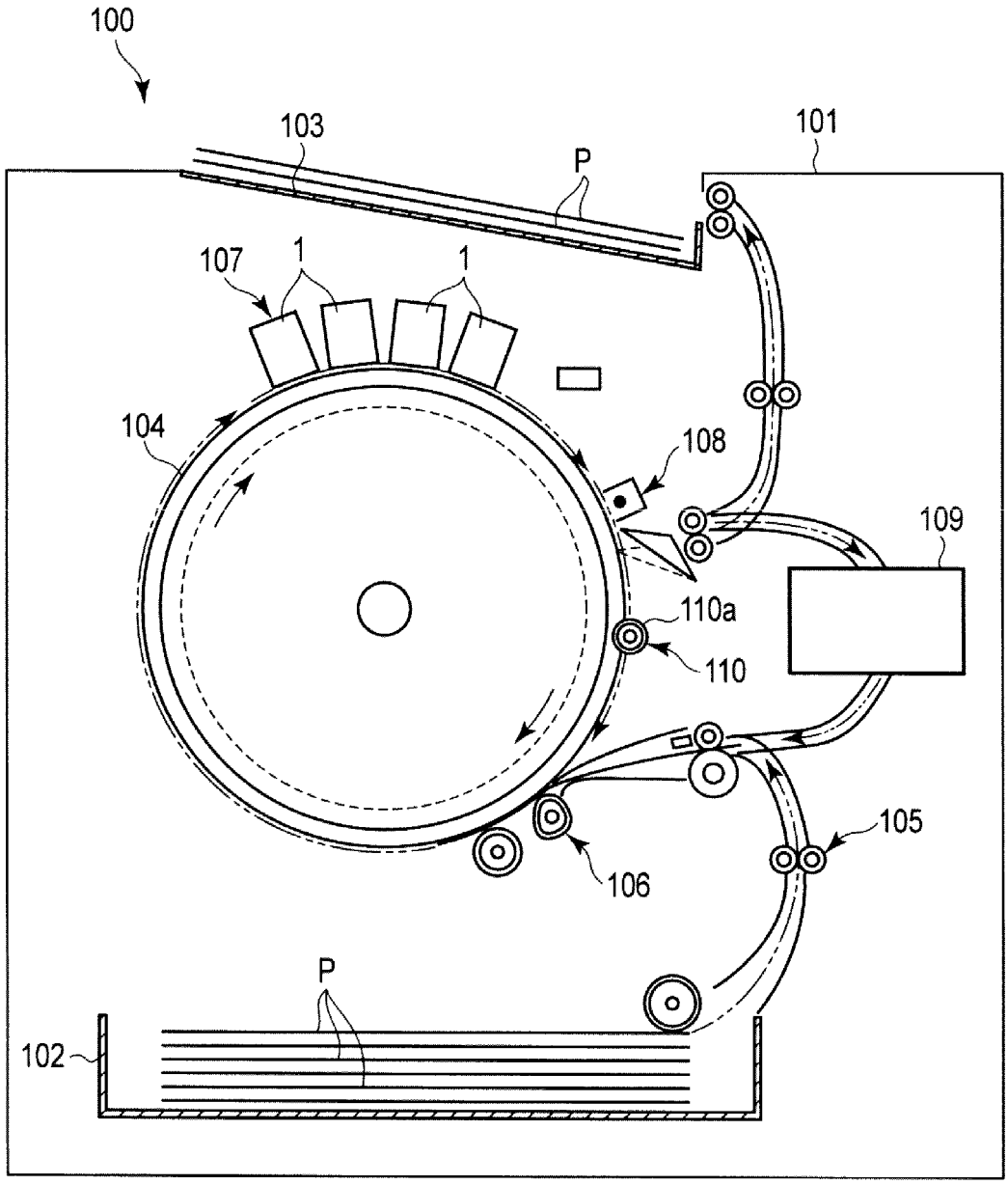
FIG. 9 schematically illustrates an ink jet apparatus according to an embodiment.

Next, an ink jet apparatus 100 including the ink jet head 1 described above will be described. FIG. 9 is a schematic diagram of the ink jet apparatus 100. The ink jet apparatus 100 may be referred to as an ink jet printer. The ink jet apparatus 100 may be a device such as a copier.

For example, the ink jet apparatus 100 performs various processes such as image formation while conveying the recording paper P which is the recording medium, for example. The ink jet apparatus 100 includes a housing 101, a paper feed cassette 102, an output tray 103, a holding roller (drum) 104, a conveying device 105, a holding device 106, an image forming device 107, a discharging device 108, an inversion device 109, and a cleaning device 110.

The housing 101 accommodates the components of the ink jet apparatus 100.

The paper feed cassette 102 is disposed in the housing 101 to accommodate a plurality of sheets P.

The output tray 103 is positioned at a top portion of the housing 101. The sheet P on which an imaged is formed by the ink jet apparatus 100 is output to the output tray 103.

The holding roller 104 includes a cylindrical frame formed of a conductor, and a thin insulating layer formed on the surface of the frame. The frame is grounded (connected to ground). The holding roller 104 conveys the sheet P by rotating in a state of holding the sheet P on the surface thereof.

The conveying device 105 includes a plurality of guides and a plurality of conveying rollers which are arranged along a sheet conveyance path through which the sheet P is conveyed. The conveying rollers are driven by motors to rotate. The conveying device 105 conveys the sheet P onto which the ink ejected from the ink jet head 1 is adhered from the paper feed cassette 102 to the output tray 103.

The holding device 106 causes the sheet P conveyed from the paper feed cassette 102 by the conveying device 105 to adhere to and held on the surface (the outer circumferential surface) of the holding roller 104. After pressing the sheet P onto the holding roller 104, the holding device 106 causes the sheet P to adhere to the holding roller 104 using electrostatic force through charging.

The image forming device 107 forms an image on the sheet P held on the outer surface of the holding roller 104 by the holding device 106. The image forming device 107 includes a plurality of the ink jet heads 1 facing the outer surface of the holding roller 104. The plurality of inkjet heads 1 form an image by ejecting each of four colors of ink such as cyan, magenta, yellow, and black onto the sheet P.

The discharging device 108 removes the sheet P on which the image has been formed from the holding roller 104 by discharging the sheet P. The discharging device 108 supplies a charge to the sheet P to discharge the sheet P, and inserts a tab between the sheet P and the holding roller 104. Accordingly, the sheet P is removed from the holding roller 104. The sheet P removed from the holding roller 104 is conveyed to the output tray 103 or the inversion device 109 by the conveying device 105.

The inversion device 109 inverts the top and bottom surfaces of the sheet P removed from the holding roller 104 and conveys the sheet P onto the outer surface of the holding roller 104 again. The inversion device 109 inverts the sheet P by conveying the sheet P along a predetermined inversion path which causes the sheet P to be flipped over, for example.

The cleaning device 110 cleans the holding roller 104. The cleaning device 110 is disposed at the downstream side of the discharging device 108 in the rotational direction of the holding roller 104. The cleaning device 110 causes a cleaning member 110*a* to abut the surface of the rotating holding roller 104, and cleans the surface of the rotating holding roller 104.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a pressure chamber connected to a nozzle;

an actuator configured to cause liquid in the pressure chamber to be ejected from the nozzle by deforming a wall of the pressure chamber, wherein the nozzle is disposed through the actuator; and a drive circuit configured to apply voltage to the actuator to drive the actuator, wherein when a droplet of the liquid is ejected from the nozzle, the voltage applied to the actuator is changed from a first value to a second value that causes the pressure chamber to expand, and then changed from a third value that is equal to the second value, or between the first value and the second value, to the first value after a time period λ, which is a primary natural oscillation period of the actuator when the pressure chamber and the nozzle are filled with the liquid.

2. The ink jet head according to claim 1, wherein after the voltage is changed from the first value to the second value, the voltage is maintained at the second value for a time period λ/2, then changed to the third value, and then maintained at the third value for the time period λ/2.

3. The ink jet head according to claim 1, wherein after the voltage is changed from the first value to the second value, the voltage is continuously changed from the second value to the third value throughout the time period λ.

4. The ink jet head according to claim 1, wherein after the voltage is changed from the first value to the second value, the voltage is linearly changed from the second value to the third value throughout the time period λ.

5. The ink jet head according to claim 1, wherein a volume of the pressure chamber when the voltage is at the first value is smaller than the one when no voltage is applied to the actuator.

6. The ink jet head according to claim 5, wherein when the ink jet head is in a ready state during which no liquid is ejected from the nozzle, the voltage is maintained at the first value.

7. The ink jet head according to claim 1, wherein the third value is between the first value and the second value, and when a predetermined number of droplets of the liquid is ejected from the nozzle in a liquid ejection operation, the voltage is changed from the first value to the second value, repeatedly changed from the third value to the second value each time period λ the predetermined number of times, and then changed from the third value to the first value.

8. The ink jet head according to claim 7, wherein in each time period λ, the voltage is maintained at the second value for a time period λ/2, then changed to the third value, and then maintained at the third value for another time period λ/2.

9. The ink jet head according to claim 7, wherein in each time period λ, the voltage is continuously changed from the second value to the third value throughout the time period λ.

10. The ink jet head according to claim 7, wherein in each time period λ, the voltage is linearly changed from the second value to the third value throughout the time period λ.

11. An ink jet head, comprising:

a pressure chamber connected to a nozzle;

an actuator configured to cause liquid in the pressure chamber to be ejected from the nozzle by deforming a wall of the pressure chamber wherein the nozzle is disposed through the actuator; and a drive circuit configured to apply voltage to the actuator to drive the actuator, wherein when a predetermined number of droplets of the liquid is ejected from the nozzle, the voltage applied to the actuator is changed from a first value to a second value that causes the pressure chamber to expand, repeatedly changed from a third value that is between the first value and the second value to the second value each time period λ the predetermined number of times, and then changed from the third value to the first value, the time period λ being a primary natural oscillation period of the actuator when the pressure chamber and the nozzle are filled with the liquid.

12. The ink jet head according to claim 11, wherein in each time period λ, the voltage is maintained at the second value for a time period λ/2, then changed to the third value, and then maintained at the third value for the time period λ/2.

13. The ink jet head according to claim 11, wherein in said each time period λ, the voltage is continuously changed from the second value to the third value throughout the time period λ.

14. The ink jet head according to claim 11, wherein in said each time period λ, the voltage is linearly changed from the second value to the third value throughout the time period λ.

15. The ink jet head according to claim 11, wherein a volume of the pressure chamber when the voltage is at the first value is smaller than the one when no voltage is applied to the actuator.

16. The ink jet head according to claim 11, wherein when the ink jet head is in a ready state during which no liquid is ejected from the nozzle, the voltage is maintained at the first value.

17. An ink jet apparatus, comprising:

an ink jet head configured to eject ink; and a conveying device configured to convey a sheet as the ink jet head ejects the ink, to form an image on the sheet, wherein the ink jet head includes:

a pressure chamber connected to a nozzle;

an actuator configured to cause liquid in the pressure chamber to be ejected from the nozzle by deforming a wall of the pressure chamber, wherein the nozzle is disposed through the actuator; and a drive circuit configured to apply voltage to the actuator to drive the actuator, wherein when a droplet of the liquid is ejected from the nozzle, the voltage applied to the actuator is changed from a first value to a second value that causes the pressure chamber to expand, and then changed from a third value that is equal to the second value or between the first value and the second value to the first value after a time period λ, which is a primary natural oscillation period of the actuator when the pressure chamber and the nozzle are filled with the liquid.

18. The ink jet apparatus according to claim 17, wherein after the voltage is changed from the first value to the second value, the voltage is maintained at the second value for a time period λ/2, then changed to the third value, and then maintained at the third value for another time period λ/2.

19. The ink jet apparatus according to claim 17, wherein after the voltage is changed from the first value to the second value, the voltage is continuously changed from the second value to the third value throughout the time period λ.

20. The ink jet apparatus according to claim 17, wherein after the voltage is changed from the first value to the second value, the voltage is linearly changed from the second value to the third value throughout the time period λ.

* * * * *